United States Patent [19]

Sills

[11] Patent Number: 4,693,442

[45] Date of Patent: Sep. 15, 1987

[54] VARIABLE LENGTH COLUMNS

[75] Inventor: James R. Sills, High Wycombe, England

[73] Assignee: DMI Fabrications Limited, High Wycombe, England

[21] Appl. No.: 879,434

[22] Filed: Jun. 27, 1986

[51] Int. Cl.[4] ..... F16M 11/00

[52] U.S. Cl. ..... 248/406.2; 108/144; 248/157; 248/409; 297/345

[58] Field of Search ..... 248/409, 405, 406.1, 248/406.2, 157, 416; 297/345, 348; 108/144

[56] References Cited

U.S. PATENT DOCUMENTS

| | | | |
|---|---|---|---|
| 1,589,847 | 6/1926 | Hansen | 248/406.1 X |
| 3,606,234 | 4/1971 | Prescott | 248/406.1 |
| 3,737,136 | 6/1973 | Snurr | 297/345 X |
| 3,880,096 | 4/1975 | Kaplan | 248/405 X |
| 4,379,540 | 4/1983 | French | 248/406.2 |
| 4,394,001 | 7/1983 | Wisniewski | 248/406.2 X |
| 4,526,334 | 7/1985 | Rantakari | 248/157 |
| 4,595,237 | 6/1986 | Nelsen | 297/345 X |
| 4,598,892 | 7/1986 | Franckowiak et al. | 248/406.2 |
| 4,613,106 | 9/1986 | Tornero | 248/405 |

FOREIGN PATENT DOCUMENTS

| | | |
|---|---|---|
| 2406338 | 8/1973 | Netherlands . |
| 0770833 | 3/1957 | United Kingdom . |
| 1461951 | 1/1977 | United Kingdom . |

*Primary Examiner*—Ramon O. Ramirez

*Attorney, Agent, or Firm*—Cushman, Darby & Cushman

[57] ABSTRACT

A variable length support column for mounting a seat on a base to form a variable height seat comprises an elongate tube and a rod longitudinally slideable together or apart to shorten or to extend the column;

a spring acting indirectly between the first tube and the rod to tend to lengthen the column;

a ring of steel balls mounted in bores in tube displaceable to engage against grooves in the rod at any one of different extensions of the column to lock the column at said extension;

and a release tube axially shiftable to release the balls into a groove in the release tube to unlock the column.

13 Claims, 3 Drawing Figures

VARIABLE LENGTH COLUMNS

FIELD OF THE INVENTION

The present invention relates to variable length columns with particular emphasis on columns for mounting seats on bases to form variable height seats, for instance office chairs.

BACKGROUND TO THE INVENTION

Many chairs are currently produced which comprise a base, often provided with castors, and a single column supporting the chair seat. Often, some means of adjusting the height of the column is provided. In more sophisticated chairs of this kind, the column is telescopic and is urged to elongate by the pressure of gas contained in a reservoir, latch means controlled by a lever being provided to lock the column in a desired position.

The present invention relates to improvements in seat columns of this kind and has particular but not exclusive application to seat columns in which elongation of the column is urged by a spring rather than by compressed gas.

In particular, the present invention relates to variable length columns e.g. support columns for mounting seats on bases to form variable height seats, comprising:

first and second elongate members longitudinally slidable together or apart to shorten or to extend the column;

means acting directly or indirectly between the first and second elongate members to tend to lengthen the column;

at least one latch member associated with one of the first and second elongate members and displacable to engage against the other of said first and second elongate members at any one of different extensions of the column to lock the column at said extension;

and means for selectively displacing said latch member or members to lock the column and for releasing said latch members to permit reverse displacement thereof to free the column.

DISCUSSION OF PRIOR ART

German Patent Specification No. DE-A-2406338 describes an adjustment mechanism for a chair seat of this kind. The latch members are a plurality of balls protruded through a ring of holes in an inner tubular member to engage against the smooth internal surface of an outer tubular member. The balls are pressed outward by an annular wedge formation on a central rod connected to an operating lever.

Such an arrangement does not reliably provide a sufficiently positive locking of the column to cope with shock loads imposed by a heavy person dropping sharply into the chair. Moreover, such a system will be susceptible to wear because the hardened steel balls used will be likely to wear and deform the inner surface of the outer tube.

British Patent Specification No. GB-A-770833 discloses a generally similar type of adjustment mechanism in the context of a variable height table. Unlike No. DE-A-2406338, this specification does not disclose the use of a spring to bias the first and second elongate tubular members to lengthen the column. In this specification a helical spring is welded to the interior of the outer tubular member to provide a seating for the balls of the adjustment mechanism.

For use in a chair support column, the adjustment mechanism needs to include a substantial source of power urging the column to lengthen. Typically, this is a powerful coil spring. In order that the column may be of pleasing proportions, the adjustment mechanism must be such as to accommodate such a spring within a pleasingly slender column. This would be difficult or impossible using the arrangement shown in No. GB-A-770833.

Furthermore, because of the greater weight to be carried by a chair compared to a table, and to the greater shock loads experienced, the use of a spring welded to the interior of a tube is not likely to provide sufficient strength and wear resistance. Furthermore, such an arrangement involves substantial difficulties in assembly since it is necessary to weld a long spring to the interior of a long tube. The methods suggested in No. GB-A-770833 such as immersion in a pewter bath are not likely to produce a system that will stand up to the great stresses involved in use in a chair column.

BRIEF DESCRIPTION OF THE INVENTION

The present invention provides a variable length column e.g. for mounting a seat on a base to form a variable height seat comprising:

first and second elongate members longitudinally slidable together or apart to shorten or to extend the column;

means acting directly or indirectly between the first and second elongate members to tend to lengthen the column;

at least one latch member associated with one of the first and second elongate members and displacable to engage against the other of said first and second elongate members at any one of different extensions of the column to lock the column at said extension;

and means for selectively displacing said latch member or members to lock the column and for releasing said latch members to permit reverse displacement thereof to free the column;

wherein in that the first said elongate member is a tubular member slideable over the exterior of the second said elongate member and having at least one aperture therein, the or each latch member is protrudable inwardly through a respective said aperture, and the exterior of said second elongate member is provided with a longitudinally extending series of surface recess formations into which the or each said latch member is engageable to lock the columns.

The said tubular member is preferably of circular cross-section but may be a flat sided member of any suitable cross-section.

Preferably, the means acting between the first and second elongate members is a spring, preferably a coil spring and most preferably a coil compression spring.

The spring is ideally so chosen as to produce a tendency to extend the column which in use will at least just be counteracted by the full weight of the lightest anticipated user of the seat.

Preferably, the recess formations are provided by a series of spaced annular grooves formed around the second elongate member. The second elongate member preferably is a rod but might be a tube.

The latch members may be mounted in through bores in the walls of the first elongate member.

Preferably the latch members are balls, for instance steel balls, which may be hardened steel balls.

The means for displacing the latch member or members to engage the recess formations may comprise a longitudinally shiftable camming member having cam formations to engage the latch member or latch members and to displace them to enter the recess formations upon longitudinal shifting of the camming member from a release position to an engaging position.

Alternatively a camming member which operates by rotational rather than longitudinal shifting might be employed.

Preferably the camming member is biased to the engaging position and control means are provided for temporarily displacing the camming member to the release position against the bias. The control means may for instance be a control lever operating to shift a control tube extending longitudinally within the column and carrying the camming member.

The first or the second elongate member may be connected to a base member by suspension means such as a coil compression spring. This feature may be used to provide spring suspension of a seat mounted to a base by the column independent of the height adjustment.

Preferably the first elongate member is received within a first tubular member connected to the first elongate member and the second elongate member is received within a second tubular member connected to the second elongate member, said first and second tubular members being telescopically interfitting and together serving to contain said first and second elongate members.

The first or the second tubular member may be connected to the seat by any suitable means such as a morse taper provided on the tubular member and received in a suitable socket in the seat. The other of the first and second tubular members may be mounted to a base.

The invention includes a seat comprising a base, a column as described above and a seat mounted on the column. In particular, the invention includes a variable height chair incorporating such a column.

BRIEF DESCRIPTION OF THE DRAWINGS

The invention will be illustrated by the following description of a preferred embodiment with the reference to the accompanying drawing in which.

DETAILED DESCRIPTION OF A PREFERRED EMBODIMENT

Figure 1:
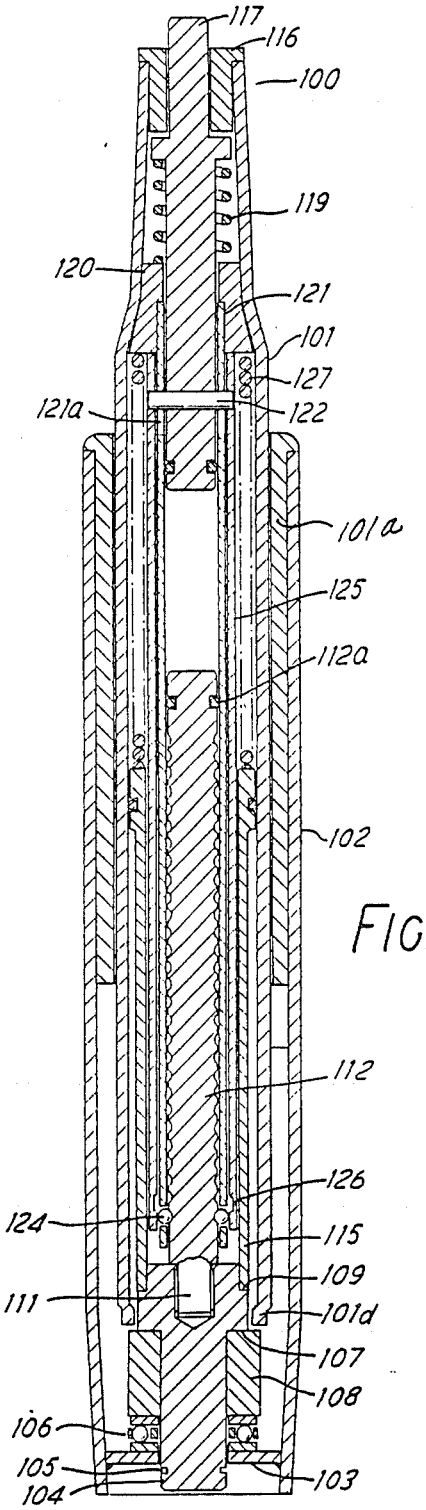
FIG. 1 is a cross-sectional view of a column according to the invention.
Figure 2:
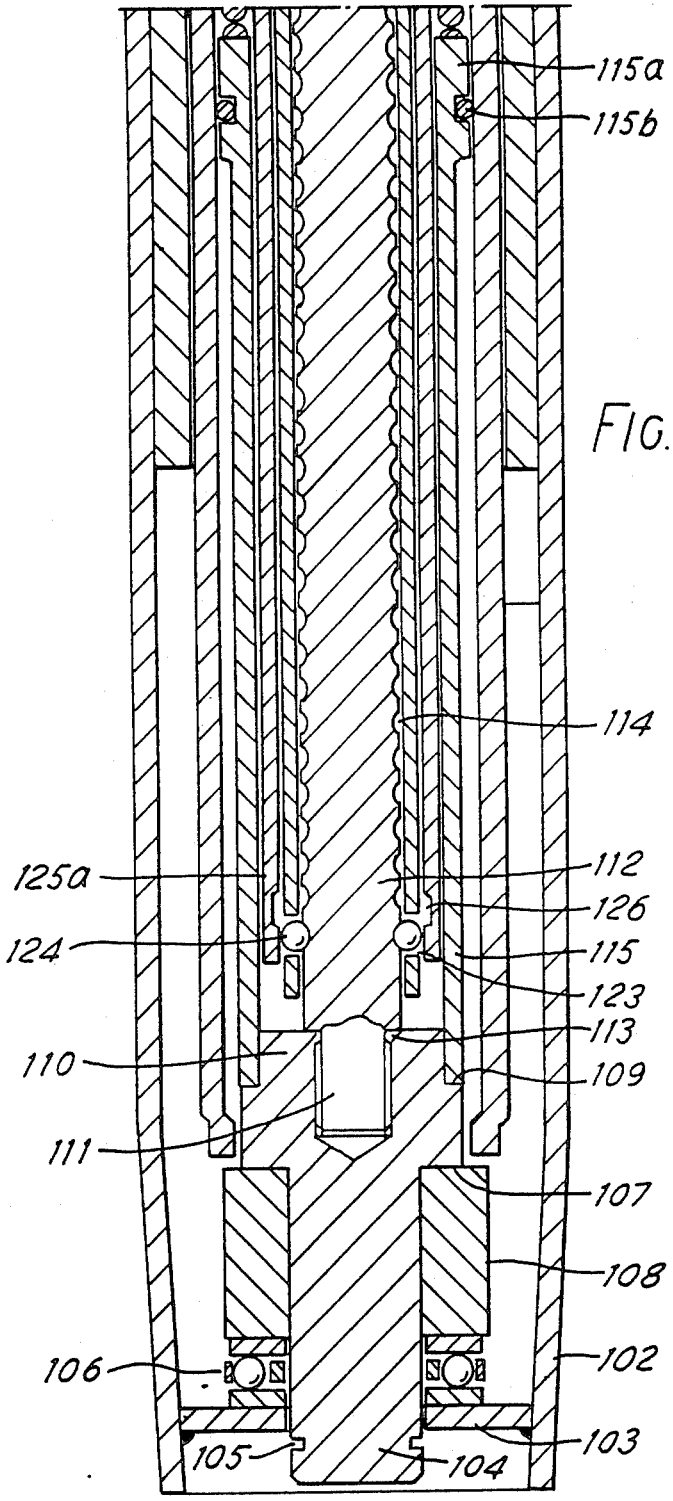
FIG. 2 is an enlargement of the lower part of FIG. 1.
Figure 3:
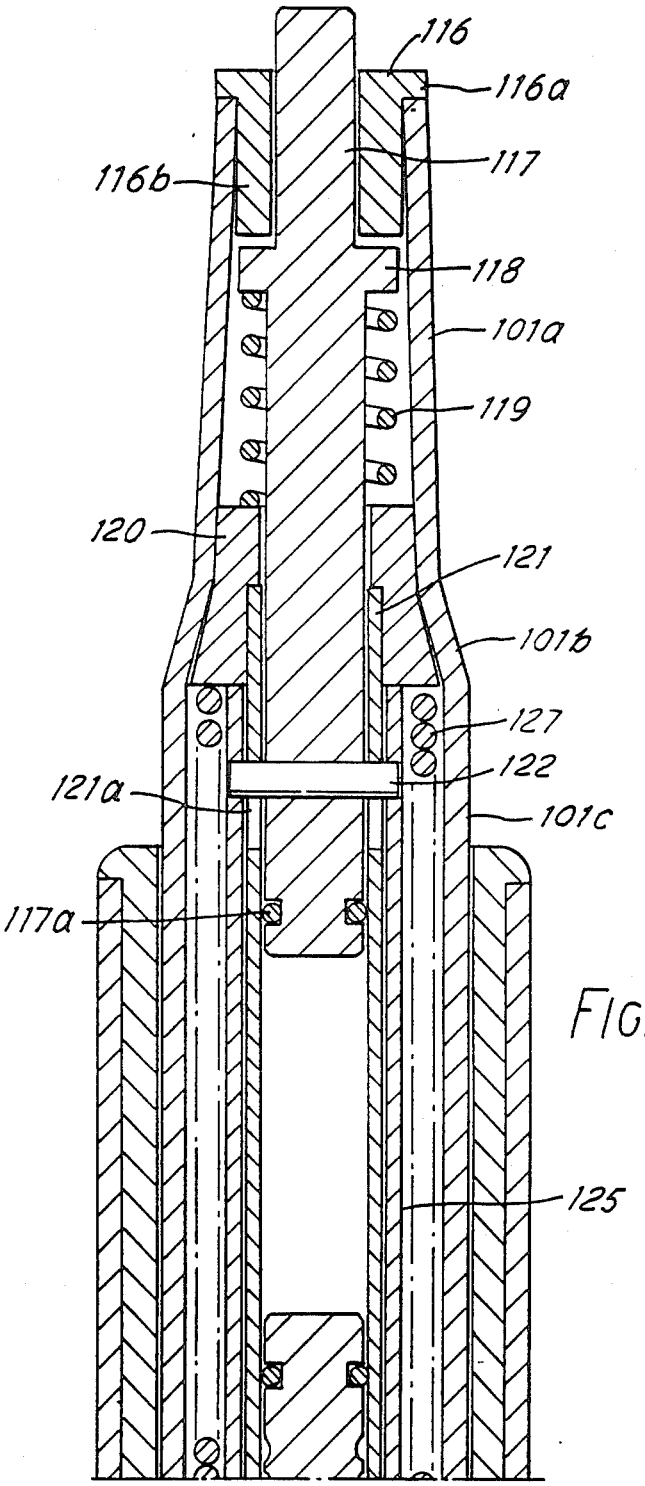
FIG. 3 is an enlargement of the upper end of FIG. 1.

As shown in the Figures, a column 100 according to the invention comprises a pair of telescopically slideable tubular members 101 (upper) and 102 (lower) contained within which members is an adjustment mechanism by which the tubular members may be locked at different column extensions.

The lower tubular member 102 is of larger diameter and the lower end of the upper tubular member 101 which is of lesser diameter is received within the tubular member 102. At the upper end of tubular member 102, a guide bush 101*a* is provided to locate and support member 101 therein.

Within the base of tubular member 102 there is welded a disc 103 having a central aperture in which is received an axially extending base plug 104. Base plug 104 is restrained against upward movement through the aperture in disc 103 by a circlip (not shown) engaging in an annular groove 105. Plug 104 is surrounded above the disc 103 by a ball bearing unit 106. A radially enlarged portion of the base plug 104 presents a downwardly facing annular shoulder 107 and trapped between shoulder 107 and the upper face of the ball bearing unit 106 is a coil compression spring 108. An upwardly directed annular shoulder 109 on the base plug 104 is provided by the junction between an uppermost portion 110 thereof and said radially enlarged portion. A central threaded blind bore in the upper face of the base plug 104 receives a reduced diameter screwed nose portion 111 of a grooved locking rod 112 constituting the second elongate member of the column as defined above. Nose portion 111 is a tight fit through the entry to the bore in plug 104 which is restricted by an annular, inwardly directed lip 113.

The grooved locking rod 112 has along its length a series of closely spaced semi-circular cross-section annular grooves 114 occupying most of its length. In an otherwise plain portion at the top of the locking rod there is provided an O-ring 112*a* seated in a single annular groove.

Extending up from base plug 104 and seated against annular shoulder 109 is a spring compressor tube 115. This extends to height slightly less than that of the top of the grooved locking rod 112 and terminates in a radially outwardly directed enlargement 115*a* containing an outwardly directed annular groove seating an O-ring 115*b*.

An annular space is generated between the grooved locking rod 112 and the interior of the spring compressor tube 115 and a second annular space is generated between the interior of the tubular member 102 and the exterior of the spring compressor tube 115.

The upper tubular member 101 has at its upper end a morse taper portion 101*a* connected via a sloping shoulder portion 101*b* to a portion of constant diameter 101*c* occupying most of the length of the tubular member. Tubular member 101 terminates at the bottom end at a swaged reduced diameter step portion 101*d*. The tubular member 101 is a close sliding fit over the enlargement 115*a* at the upper end of the spring compressor tube 115 and seals against the O-ring 115*b* contained in that enlargement. The step restriction 101*d* in tubular member 101 at its base is such that it will not pass over the enlargement 115*a* at the head of the spring compressor tube 115 and this provides a maximum elongation stop for the column.

At the top of tubular member 101 is seated a nylon bush 116 having a radially extending flange 116*a* seated on the top of the tube 101 and a main body portion extending 116*b* into the bore of the morse taper portion 101*a* of the tubular member 101. Seated in the bore of the bush 116 is a release rod 117 having an upper portion protruding through the bush 116. A short radially enlarged portion 118 of the release rod 117 seats beneath the bush 116.

A coil compression spring 119 is received over the portion of the release rod 117 below the enlarged portion 118. Below the spring 119 there is provided within the tubular member 101 a stop member 120 having an external shape corresponding to the internal shape of the tubular member 101 in the region where the morse taper connects to the constant diameter portion 101*c* through the sloping shoulder 101*b*. The stop member 120 has a central bore therethrough receiving the release rod 117. Spring 119 acts between the release rod enlarged portion 118 and the top of the stop member 120 to bias the release rod upwardly. In the lower face of the stop member 120 the central bore is of enlarged diameter to firmly receive and seat a ball carrier tube 121 which is a close fit over the lower end of the release rod 117. A sliding seal between the release rod 117 and the ball carrier tube 121 is provided by an O-ring 117*a* seated in an annular groove toward the lower end of the release rod 117. A pair of axially extending slots 121*a* are provided on opposed sides of the ball carrer tube 121 to receive a cross pin 122 extending transversely through the release rod 117 above the O-ring 117*a* at the end of the rod 117.

At its lower end, the ball carrier tube 121 is a close sliding fit over the grooved locking rod 112 and forms a sliding seal with the O-ring 112*a* provided in the upper end of the said locking rod.

Adjacent the bottom of the ball carrier tube 121 there are provided a circle of bores 123 through the wall of the tube in each of which is received a hardened steel ball 124 of a diameter marginally less than the diameter of the respective bore.

Within the annular space between the exterior of the ball carrier tube 121 and the interior of the spring compressor tube 115 there is received a release tube 125 which at its upper end abuts the base of the stop member 120 and receives the cross pin 122 thus fixing the release tube to the release rod 117. A lower end portion 125*a* of release tube 125 acts as a camming member and has on its interior face an annular groove 126 of a sufficient depth to accommodate approximately half the diameter of a ball 124. With the release tube in its normal rest position abutting the stop member 120, the lowermost portion of the release tube 125 presses the balls 124 into an adjacent groove 114 of the grooved locking rod 112.

Finally, in the annular volume between the release tube exterior and the interior of the tubular member 101 there is received a powerful coil compression spring 127 acting between the stop member 120 and the upper end of the spring compressor tube 115. This spring 127 acts indirectly between the first elongate member provided by the ball support tube and the seond elongate member provided by the locking rod tending to force these members telescopically apart. Such telescopic movement is prevented by the engagement of the balls 124 in the grooves 114 of the locking rod 112 so long as the balls are held in place by the release tube 125.

Depression of the protuding portion of the top of release rod 117 by a suitable lever lowers the release rod 125 against the force of the spring 119 to bring the groove 126 of the release rod behind the balls 124 allowing them to fall out of the groove 114 of the locking rod in which they are at that time received. With the release rod 117 depressed in this way, the first and second elongate members are free to be displaced by the coil spring 127 to elongate the column or to be driven by force applied to the upper tubular member 101, for instance by the weight of a user of a seat mounted thereon, to contract the column against the force of the coil spring 127. Release of the ocking rod 117 raises the release tube 115 to push the balls 124 into the nearest groove 114 of the locking rod 112 thus locking the column at any desired extension.

Swivelling movement of a seat mounted on the morse taper of the tubular member 101 is accommodated by the ball bearing unit 106. Cushioning of the column is provided by the spring 108. If a less cushioned effect is desired this may be replaced by a hard rubber stop.

Extensive testing has shown that the mechanism is strong, wear resistant, resistant to shock load and can be made pleasingly compact. In an ultimate test to destruction, the unit remained a completely safe, stable entity.

The mechanism specifically described above provides a number of significant advantages.

Such a mechanism allows a chair height adjustment of 72 mm minimum from a length of 220 mm in the contracted position whilst accommodating the entire mechanisms within an outer diameter of 28 mm. A very powerful coil lift spring can be accommodated around the lock/release mechanism within a 24 mm bore tube whilst retaining the ability to lift a chair weighing about 50 pounds.

It is preferred that the outer diameter of the column should be less than 45 mm, preferably less than 30 mm and preferably about 28 mm.

Significant manufacturing advantages are also presented. The central grooved locking rod may be of less than 10 mm diameter but remain extremely strong even when grooved since all the forces applied are entirely of tension or compression. The locking forces directed through the balls are in toward the rod axis, against which forces a rod is extremely strong. This contrasts with the arrangement shown in No. DE-A-2406338 where the force directed by the balls is outwards so that the tube in question is subjected to stretching loads which may only be partially contained by the hoop strength of the thin wall of the tube leading the tube being dented outwardly.

External grooves on a rod are extremely simple to machine to an accurate spacing and depth whatever the length of the rod which means that the ball engagement depth remains constant leading to a good cooperation with the release tube. If an attempt is made to machine similar formations on the interior of a tube in a variation of what is shown in No. DE-A-2406338, the manufacturing process is much more difficult and large tolerances are needed to allow for tool push-off, leading to poor performance.

For maximum wear resistance, given the small contact area between the locking rod and the balls, it is necessary that the groove faces be hardened. This is extremely easy with the utilisation of a locking rod. There is a good choice of materials available and it is easy to obtain consistent results. It would be difficult or impossible to obtain similar constant results in hardening the interior of commercially available tubes.

The invention has been described with reference to the characteristics of the illustrated embodiment but it should be understood that many modifications and variations thereof are possible within the scope of the invention.

The illustrated column provides a smooth and reliable height adjustment with a positive locking mechanism whilst avoiding the cost and complexity of a gas compression system and the risk of failure of pressure seals or explosion.

Although the invention has been presented as relating to columns for seats, it is to be understood that variable length columns of the kind described can be employed in a wide variety of other situations, subject where appropriate to being produced in small or larger sizes and with appropriate spring rates. Examples of such other uses include adjustable height tables, in vehicles as bonnet, boot, hatch or tail gate lifts, in chair tilt mechanisms or any system where a column requiring accurate infrequent securely locked adjustment is wanted.

I claim:

1. A variable length support column comprising first and second elongate members longitudinally slidable together and apart to shorten and to extend the column respectively;

means acting at least indirectly between the first and second elongate members to tend to lengthen the column;

at least one latch member associated with one of the first and second elongate members and displacable to engage against the other of said first and second elongate members at any one of different extensions of the column to lock the column at said extension;

and means for selectively displacing said at least one latch member to lock the column and for releasing said at least one latch member to permit reverse displacement thereof to free the column, wherein the first of said elongate members is a tubular member slideable over the exterior of the second said elongate member and having at least one aperture therein, the said at least one latch member is protrudable inwardly through a respective said aperture, and the exterior of said second elongate member is provided with a longitudinally extending series of surface recess formations into which the said at least one latch member is engageable to lock the column.

2. A column as claimed in claim 1 wherein the means acting between the first and second elongate members is a spring.

3. A column as claimed in claim 2 wherein the said spring is a coil compression spring.

4. A column as claimed in claim 2 for use as a seat support wherein the spring is so chosen as to produce a tendency to extend the column which in use will at least just be counteracted by the full weight of the lightest anticipated user of the seat.

5. A column as claimed in claim 1 wherein, the recess formations are provided by a series of spaced annular grooves around the second elongate member.

6. A column as claimed in claim 1 wherein the second elongate member is a rod.

7. A column as claimed in claim 1 wherein the said at least one latch member is a ball.

8. A column as claimed in claim 1 wherein the means for displacing the said at least one latch member to engage the respective recess formation comprises a longitudinally shiftable camming member having a camming surface to engage the said at least one latch member and to displace said latch member to engage the respective recess formation upon longitudinal shifting of the camming member from a release position to an engaging position.

9. A column as claimed in claim 8 wherein the camming member is biased to the engaging position and control means are provided for temporarily displacing the camming member to the release position against the bias.

10. A seat comprising a base, a column as claimed in claim 1 and a seat member mounted on the column.

11. A column as claimed in claim 2 wherein the said spring is a coil compression spring disposed exterior to said first and second elongate members.

12. A column as claimed in claim 11, further comprising an outer tubular member surrounding said first elongate member and defining therebetween an annular space wherein said coil compression spring is disposed, said outer tubular member being coupled to said first elongate member so as to move therewith.

13. A column as claimed in claim 12, further comprising a tubular guide member coupled to and surrounding said second elongate member, said tubular guide member being disposed so as to extend into said annular space in sliding contact with the inner surface of said outer tubular member and abutting one end of said coil compression spring.

* * * * *